US005611151A

United States Patent [19]

Jacob

[11] Patent Number: 5,611,151

[45] Date of Patent: Mar. 18, 1997

[54] STRIP COOLING, HEATING, WIPING OR DRYING APPARATUS AND ASSOCIATED METHOD

[75] Inventor: William L. Jacob, Pittsburgh, Pa.

[73] Assignee: Busch Co., Pittsburgh, Pa.

[21] Appl. No.: 259,750

[22] Filed: Jun. 10, 1994

[51] Int. Cl.[6] ..... F26B 7/00

[52] U.S. Cl. ..... 34/395; 34/62; 34/631; 34/638; 427/378

[58] Field of Search ..... 34/62, 393, 395, 34/428, 631, 636, 638, 643; 427/348, 378, 398, 5

[56] References Cited

U.S. PATENT DOCUMENTS

| | | | |
|---|---|---|---|
| 2,851,383 | 9/1958 | Einhiple | 34/638 |
| 3,048,383 | 8/1962 | Champlin | 34/156 |
| 3,068,586 | 12/1962 | Vaughan et al. | 34/62 |
| 3,199,224 | 8/1965 | Brown | 34/156 |
| 3,278,330 | 10/1966 | De Vau et al. | 427/398.5 |
| 3,447,174 | 6/1969 | Candor et al. | 34/92 |
| 3,529,357 | 9/1970 | Schuette et al. | 34/446 |
| 3,592,585 | 7/1971 | Candor et al. | 34/631 |
| 3,777,408 | 12/1973 | Marchal | 34/156 |
| 4,406,388 | 9/1983 | Takashi et al. | 34/156 |
| 4,505,050 | 3/1985 | Jung et al. | 34/160 |
| 4,625,431 | 12/1986 | Nanba et al. | 34/62 |
| 4,750,715 | 6/1988 | Harada et al. | 34/156 |
| 4,785,985 | 11/1988 | Hurtgen | 34/156 |
| 5,201,132 | 4/1993 | Jacob | 34/13 |
| 5,408,759 | 4/1995 | Bass | 34/104 |

FOREIGN PATENT DOCUMENTS

| | | | |
|---|---|---|---|
| 77182 | 10/1970 | Germany | 34/428 |

OTHER PUBLICATIONS

Jet Impingement Heat Transfer From Jet Tubes and Orifices, Nat'l. Heat Transfer Conference, 1989, HTD–vol. 107, pp. 43–50.

Metal Producing, Jul., 1990, pp. 33, 53.

*Primary Examiner*—F. Daniel Lopez

*Attorney, Agent, or Firm*—Arnold B. Silverman; Eckert Seamans Cherin & Mellott

[57] ABSTRACT

Apparatus for supplying treatment gas, such as for cooling, heating, wiping or drying is provided by a gas handling unit which has a body portion for receipt and discharge of the gas and a plurality of elongated nozzles which may be (a) rigid nozzles, or (b) flexible nozzles which assume a substantially rigid projecting position when gas is flowing through the nozzle and a collapsed retracted or partially collapsed position when gas is not flowing. The unit may discharge gas in more than one direction. Certain preferred arrangements of nozzles are provided. The nozzles preferably have an inlet portion which is of greater cross-sectional area than the outlet portion and may have an inlet portion which is generally cylindrical cooperating with a generally conical outer discharge portion. In a preferred embodiment, the gas treatment apparatus may be employed in cooling metal coils. An associated method is provided.

23 Claims, 5 Drawing Sheets

STRIP COOLING, HEATING, WIPING OR DRYING APPARATUS AND ASSOCIATED METHOD

BACKGROUND OF THE INVENTION

1. Field of the Invention

The present invention relates to an apparatus for supplying treatment gas which provides for positioning of discharge nozzles close to workpieces during apparatus operation while resisting damage to such workpieces. It also provides a cooling, heating, wiping or drying system for various workpieces including coils of material such as metal coils and, more specifically, it relates to such a system which is adapted for high speed, thermally efficient processing of metal strip.

2. Description of the Prior Art

It has long been known that for many purposes a combination of materials may provide an advantageous blend of properties for a given product. Among such combinations are the coating of steel strip with a relatively thin layer of zinc in a galvanizing process.

In respect of continuous galvanizing, a steel coil provides a continuous strip which is immersed in a molten bath of zinc, is passed through a furnace and is subsequently cooled prior to recoiling. Various types of cooling means for such systems have been known. See, generally, Metal Producing, July, 1990, pages 33, 53.

It has been known in the galvanizing art to employ elongated rigid cooling tubes having longitudinal slots therein. Such tubes are positioned relatively close to the strip being cooled, e.g., on the order of about 5 inches. A number of problems have arisen from such constructions. More specifically, the close proximity of the slots to the strip has resulted in inefficient air flow as the spent gas which has already had contact with the strip surface tends to be re-entrained or interfere with efficient flow of the cooling gas from the slots to the strip surface. Also, occasionally either the strip or the slotted tube would be damaged as a result of undesired contact therebetween.

A general disclosure of the use of plates with orifices or jet tubes in heating, cooling, or drying of various industrial products is contained in Jet Impingement Heat Transfer From Jet Tubes in Orifices, National Heat Transfer Conference, 1989, HTD-Vol. 107, pages 43–50. While not specifically directed toward the cooling of metal strip, the concept of multiple jets for impinging air on a plate and exhausting such air is discussed.

My prior U.S. Pat. No. 5,201,132 discloses a system and an associated method for cooling, heating, wiping or drying strip, such as metal strip. It provides the use of a single unit or a pair of units having a source of gas, a plenum, and a plurality of fixed nozzles which are adapted to direct gas onto a passing strip.

There has been a significant problem in respect of the need to treat coils of materials, such as metal coils, particularly with respect to cooling the same. For metal or steel coils that have been heated during processing, such as in hot rolling, it is not uncommon, particularly during summer months in a warm climate for it to take a coil several days to cool to ambient temperatures. Obviously, an effective means for accelerating cooling of coils could expedite transport of the coil to either further working within the same plant, or shipment to a customer.

There has also been a problem with respect to prior art systems having rigid nozzles, in some instances, coming into undesired contact with the workpiece and risking damage to both, or restricting access and visibility of portions of the system to plant workers.

There remains, therefore, a very real and substantial need for improved cooling, heating, wiping and drying systems for elongated coils of material, such as metal coils. There is a further need for a system which would involve delivery of gas for treatment of any desired type while minimizing the risk of damage to equipment or workpieces by contact between the workpiece and the coils, as well as for means for permitting increased access of floor workers and maintenance people to the system.

SUMMARY OF THE INVENTION

The present invention has provided a system for improved treatment of coils as by cooling such metal coils which have been subjected to hot rolling or galvanizing, for example, or by heating, wiping, drying workpieces or other gas treatment. The invention also provides apparatus and an associated method which will provide gas for whatever reason desired through a nozzle which is structurally substantially rigid while providing for automatic partial or total collapse of the nozzle when gas of a desired velocity and pressure is not flowing through the nozzle.

Means are provided for introducing gas, such as air, into the body portion of the gas handling means in order to cause the gas to emerge from one or more sides of the apparatus. The apparatus contributes to efficient thermal transfer at the coil by providing regions adjacent to the projecting nozzles for exhaust of spent gas. These regions, while normally stable, may be made to become unstable by design. In the case of heat transfer, this instability can be used to cause the flexible nozzles to constantly change the point of jet impingement, thereby turbulating the boundary layer and increasing heat transfer. Depending upon the temperature and air velocity the system can be employed to cool, heat, wipe or dry a workpiece.

A number of preferred relationships in respect of the nozzles are provided. A corresponding method is provided.

The apparatus of the present invention includes gas handling means which have a body portion for receipt and discharge of gas. If desired, ductwork for delivery of gas to the gas handling means can be eliminated and ambient air can be introduced through intake portions of the gas handling means. The gas is delivered exteriorly of the equipment through a plurality of flexible nozzles which are generally rigid and open under the influence of flowing gas, but totally or partially collapse after gas flow is withdrawn. To the extent to which the flexible nozzles are horizontally or angularly disposed with respect to the horizontal, they will completely or partially retract after gas flow is withdrawn. To the extent that they project vertically downwardly, there would be no retraction under such gas withdrawal conditions. Reference herein to total or partial collapse or to retraction herein in respect of flexible nozzles shall be interpreted in this manner. This permits the nozzles to automatically function in the desired manner when gas flow is initiated, but upon termination of such gas flow to assume a total or partial non-obstructing position. In a preferred embodiment, the nozzles have an inlet portion which is larger in cross-sectional area than the outlet portion and the outlet portion is of generally conical configuration. The conical shape at the discharge end tends to produce a back-pressure which contributes to desired tube inflation.

The gas handling means may have a plurality of first nozzles disposed in rows with nozzles in adjacent rows staggered with respect to each other emerging from a first side of the gas handling means. In some uses, a similar second army of nozzles emerging from a generally opposite side of said gas handling means is employed to thereby provide gas emerging from two sides of the apparatus.

As a majority of the heat within a metal coil is released through the edges, and the percentage of heat so released can be on the order of 90 percent, applying cooling gas to such edges is an efficient means of effecting such cooling. With the embodiment of the invention wherein gas is discharged from two sides of the gas handling means more than one coil can be cooled at the same time.

It is an object of the present invention to provide a gas treatment system which facilitates efficient, uniform cooling, heating, wiping or drying and rapid withdrawal of the spent gas to avoid thermal contamination of such gas supplied to the workpiece by the projecting nozzle elements.

It is a further object of the present invention to provide such a system wherein a spent gas receiving region facilitates ready discharge of the gas which has had heat exchanging contact with the coil.

It is a further object of the present invention to provide such a cooling system which resists undesired contact between the nozzles and the workpiece.

It is another object of the present invention to provide such a system which may be provided in a relatively small space.

It is an object of this invention to provide such a system which has high velocity cooling gas flow combined with a low pressure impedance cooling system.

It is yet another object of the present invention to provide uniform heat transfer over the end of the coil.

It is another object of the present invention to provide such a system which is adapted for use with a large variety of coil sizes and materials.

It is a further object of the invention to provide such a system which employs low volume cooling gas flow for a given rate of heat transfer as compared to the volumetric flow required by systems employing prior art devices.

It is a further object of the present invention to provide such a system for use in cooling, heating, wiping or drying metal workpieces.

It is a further object of the present invention to employ flexible nozzles will, upon cessation of flow of gas therethrough, assume a retracted position in non-interfering relationship and spaced a greater distance from the workpiece than when the nozzle is extended under the influence of gas flow.

It is a further object of the present invention to provide a system for the cooling of metal coils which will greatly accelerate cooling of coils which have been heated during fabrication.

It is a further object of the present invention to provide such a system which will resist undesired damaging contact between the workpiece and the nozzles.

It is a further object of the present invention to provide such a system which does not require the use of duct work.

These and other objects of the invention will be more fully understood from the following detailed description of the invention on reference to the illustrations appended hereto.

DESCRIPTION OF THE PREFERRED EMBODIMENTS

While for simplicity of disclosure herein, emphasis will be placed upon use of the apparatus and method of the present invention in cooling coils, such as steel or aluminum coils, for example, it will be appreciated that the concepts of the invention may be employed advantageously in a number of other environments.

Aluminum coils, which require cooling, are generally no higher in temperature than 750° F. (hot band) and 350° F. (cold band). The desired cooling temperature for slitting is generally between 175° F. and 120° F. A major production bottleneck arises when the hot seasonal temperatures (i.e. 95° F. to 100° F.) arrive and coils cannot be cooled quickly. A coil cooler designed in accordance with the dimensional and arrangement characteristics described herein can be made to satisfy specified coil cooling requirements by providing uniform high heat transfer conditions on the face of the workpiece. The features which allow this coil cooler to achieve rapid cooling are heat transfer uniformity across the workpiece, high heat transfer rate because of jet impingement which produces a thin boundary layer, high heat transfer because of the proximity to the workpiece achievable with the flexible nozzles (and rigid), and the incorporation of a spent turbulent air relief zone which virtually eliminates cross flow problems and thermal contamination of the cooling air supply.

Steel coils typically can have temperatures as low as 240° F. and be required to cool to 140° F. as rapidly as possible before further processing is allowed.

Figure 1:
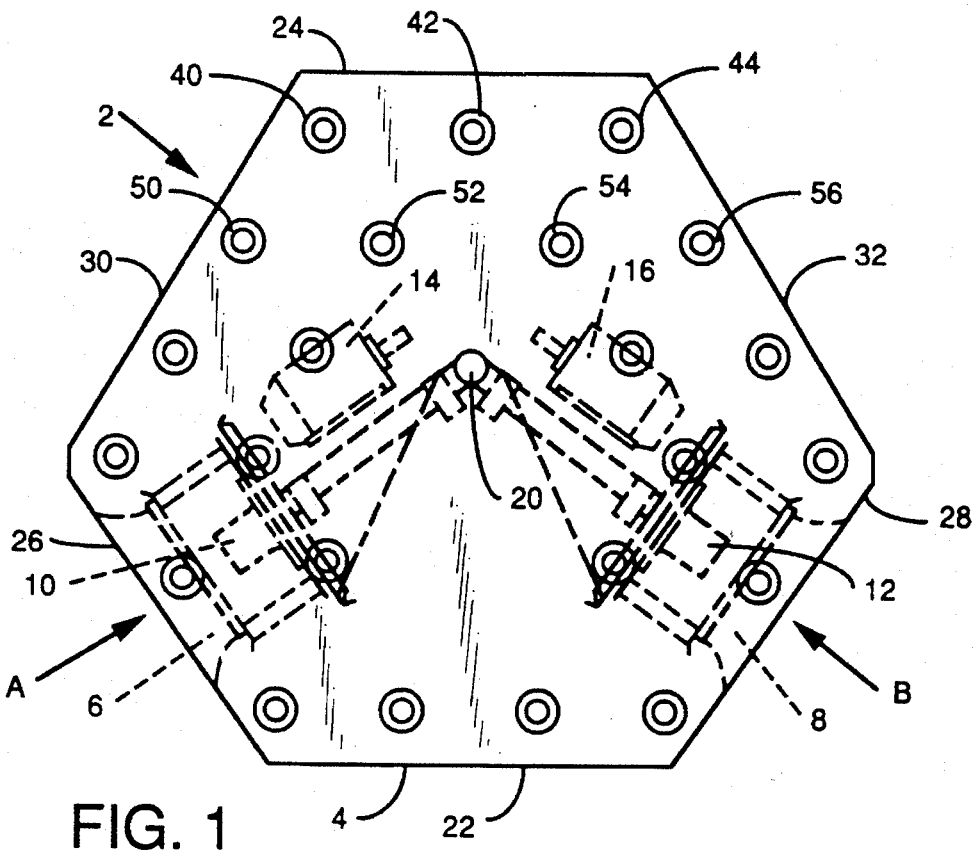
FIG. 1 is a front elevational view of a form of apparatus of the present invention.
Figure 2:
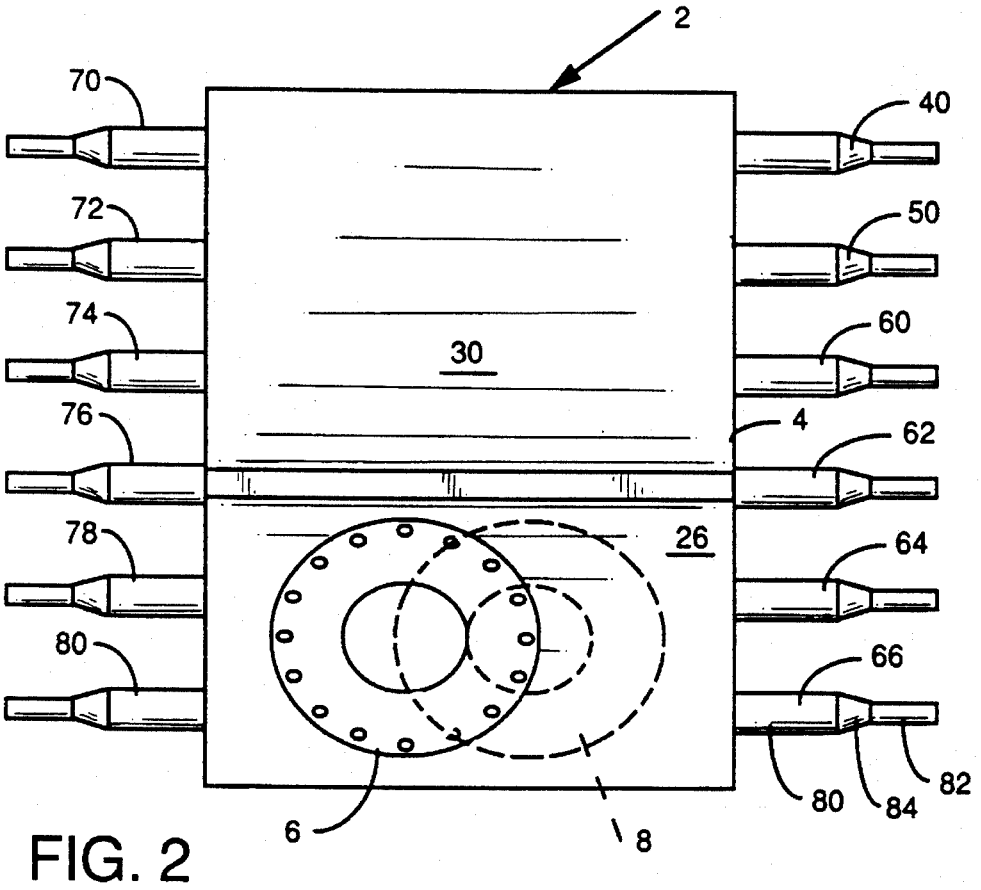
FIG. 2 is a left side elevational view of the apparatus shown in FIG. 1.
Figure 3:
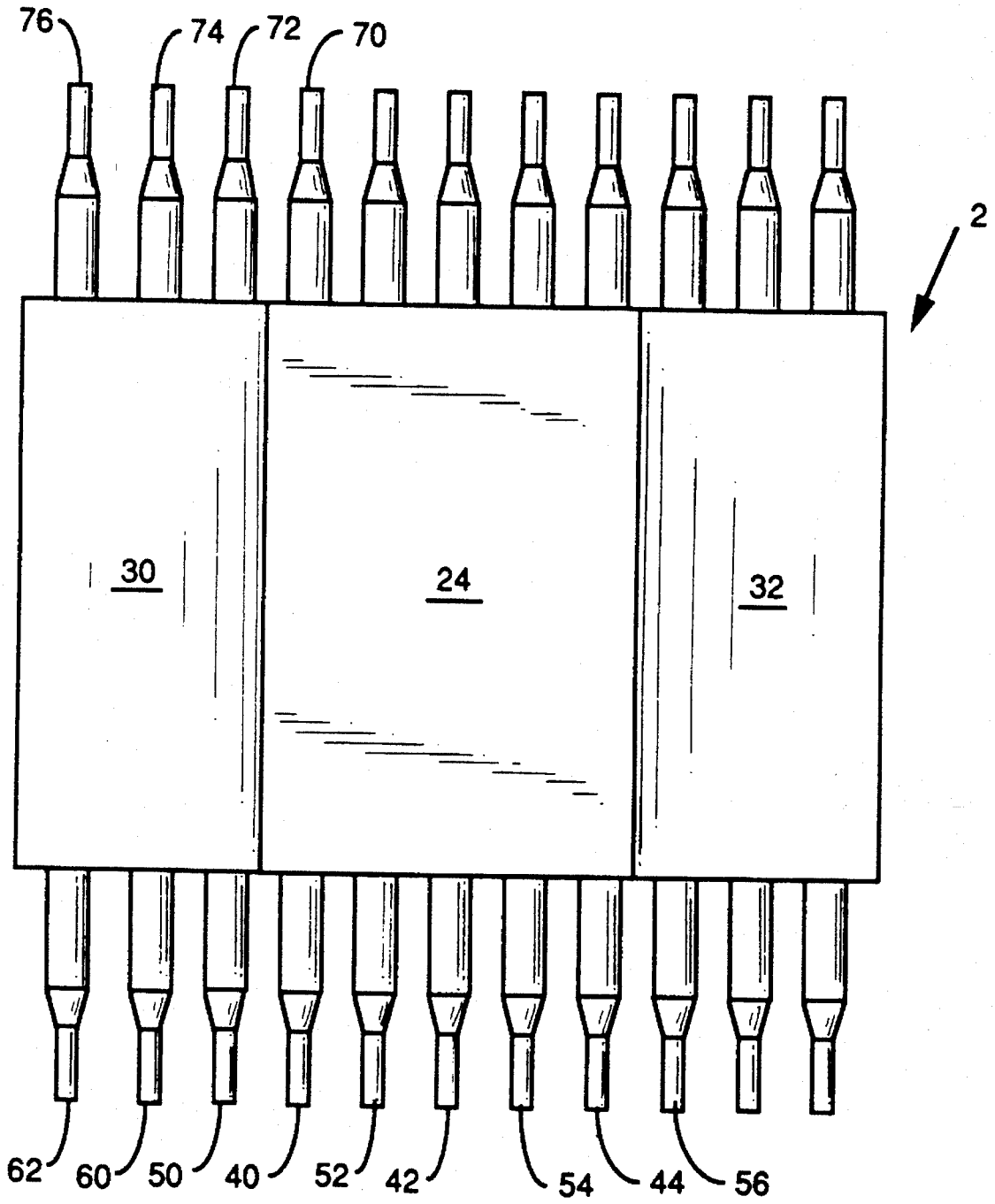
FIG. 3 is a top plan view of a unit of the apparatus shown in FIG. 1.

Referring to FIGS. 1 through 3 there is shown a preferred form of the apparatus of the present invention. The gas handling means 2 has a body portion 4 which includes air intake recesses 6 and 8 which have fans which may be of the plug fan type, each energized through motors 14, 16, respectively, so as to draw gas into the body portion 4 in the directions indicated by arrows A and B, The gas so drawn in is delivered to the nozzles for discharge exteriorly of the gas handling means at the desired volume and velocity. The center of coil (not shown in this view) will be generally at 20. It will be noted that the gas handling means, in the form shown, has a front lower plate edge 22 which is generally parallel to a front upper plate edge 24 and has sidewalls which consist of outwardly diverging portions 26, 28 and inwardly converging portions 30, 32, such that the upper edge 24 is smaller than or equal to lower edge 22. A substantially identical rear plate is provided.

The nozzles are, as shown in FIG. 1, presented in a group of rows with nozzles 40, 42, 44, being in a first row and nozzles 50, 52, 54, 56 being in a second row generally parallel thereto and having one more nozzle. It will be noted that the nozzles of the first row are offset from the nozzles of the second row such that, in the preferred embodiment, the nozzle in an adjacent row is aligned with a mid-point between the pair of nozzles closest in the adjacent row, such as the position of nozzle 40 with respect to nozzles 50 and 52, for example. It will be noted that the nozzles at the ends of each of the rows are spaced generally the same distance from the adjacent sidewalls 26, 28, 30, 32. It will be seen in FIG. 2 that the nozzles 40, 50, 60, 62, 64, 66 are a portion of the nozzles facing in a first direction for discharging gas in that direction and nozzles 70, 72, 74, 76, 78, 80 face in the opposite direction, generally about 180° out of phase for delivering gas in that direction. These nozzles are substantially rigid and may be made of metal.

The nozzles preferably have an internal diameter of about 1 to 6 inches with the particular function influencing the choice of size, for example, for strip cooling or strip heating may have nozzles of about 1 to 2 inch diameter, while coil cooling or strip drying might have a nozzle diameter of about 1 to 3 inches. It is preferred, in general, that the center-to-center spacings of nozzles within a given row be about 4.5 to 30 inches and preferably about 6 to 18 inches. The spacing between rows measuring between lines drawn through the centers of the nozzles in the respective rows is about 4 to 26 inches and 5⅛ to 15⅝ inch.

With reference to nozzle 66 in FIG. 2, it will be noted that in this embodiment, the nozzle has an inlet portion 80 which is of generally cylindrical shape and an outlet portion 82 which is generally smaller in area than inlet portion 80, but also is of cylindrical shape with the outlet portion having a section 84 which is tapered so as to effect an efficient connection with the inlet portion 80. This embodiment has rigid nozzles.

It will be appreciated that the apparatus involves gas, such as air being taken in through the inlet 6 and 8 being delivered to the nozzles for discharge therefrom onto the desired workpiece. In the preferred embodiment, the nozzle inlet portion 80 will have a diameter of about 2 to 12 inches and preferably about 2 to 6 inches and the nozzle outlet portion 82 will have a diameter of about 1 to 6 inches and preferably 1 to 3 inches. Certain preferred sizes may be employed for particular installations depending upon the nature of the gas treatment, the materials being employed and the temperatures involved.

In the preferred embodiment, the ratio of the distance from the outlet portion 82 to the workpiece and the diameter of the outlet portion 82 is referred to as H/D. The value selected for H/D depends on conditions present in and around the workpiece. Within limits, smaller values for H/D are preferable because they product the most energy efficient configuration. H/D values will generally vary between 5 and 14. The preferred range for H/D is about 6 to 9.

It will be noted that in the embodiment of FIGS. 1 through 3, gas is discharged from a single unit in two directions. This facilitates cooling of two adjacent coils or other workpieces.

Figure 4:
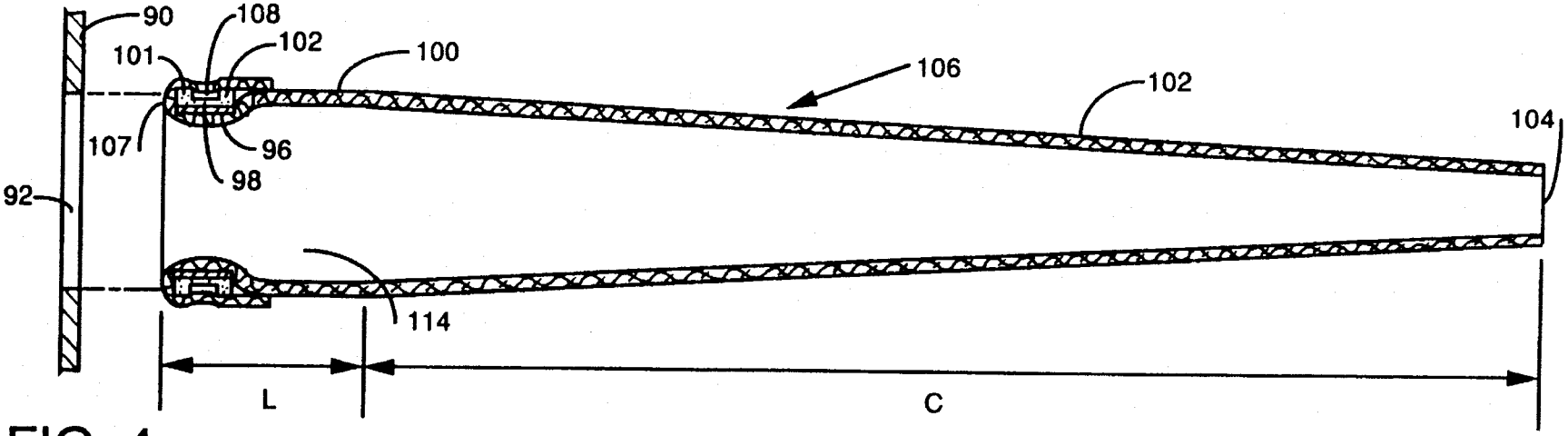
FIG. 4 is a schematic cross-sectional view of one form of nozzle of the present invention.

Referring to FIG. 4, there is shown a preferred embodiment of the nozzle of the present invention. Unlike prior art nozzles, the present invention contemplates using a flexible nozzle which will be substantially rigid, cantilevered and fully open when gas is flowing therethrough at the desired volume and velocity, but when such gas flow is terminated, will fold downwardly under the influence of gravity. Such action provides the advantages of not only minimizing the desired risk of potentially damaging contact between the workpiece and the nozzles, but also provides increased space for access between the gas treating equipment and other pieces of equipment or workpieces for physical entry by workmen or for visual observation, or both.

As shown in FIG. 4, the nozzle in its inflated position, has a generally cylindrical intake portion 100 and a generally conical outlet portion 102 which terminates in a discharge opening 104. In a preferred embodiment, the diameter of nozzle portion 100 will be about 2 to 6 inches and the diameter of the discharge opening will be about 1 to 3 inches. In the present embodiment, the means for attaching the nozzle 106 to the remainder of the gas handling means involves providing a cylindrical hole 92 in the nozzle supporting tube wall 90.

A resilient snap ring 96, which may be made of steel and have a circumferential extent of 360 degrees, may be adhesively bonded to a felt member which has a base wall 98 and a pair of inwardly projecting folded portions 101, 102 which define an outwardly open recess 108. The felt member 98, 101, 102 is preferably at least as wide as the snap ring 96 and is generally circumferentially coextensive therewith. A free end of the nozzle 106 is folded outwardly and reentrantly forwardly and sewn or otherwise secured to retain circumferential 100 or cuff 107 within which the securing means are provided. In effecting securement of nozzle 106 to female retainer which consists of wall 90 and hole 92, the snap ring is resiliently compressed after which recess 108 is placed in hole 92 adjacent wall 90 such that, upon release, the wall 90 will enter recess 108 to effect securement of the nozzle thereto. In this embodiment, the cylindrical portion 110 has an axial length L and the conical portion has an axial length C.

Figure 5:
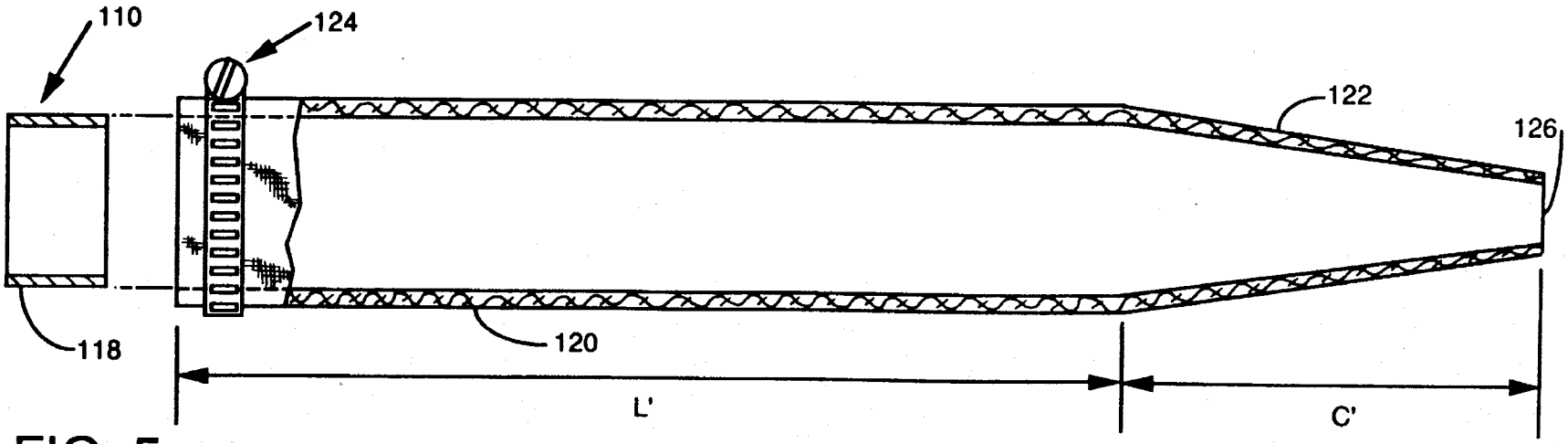
FIG. 5 is a schematic view partially in cross-section of another form of nozzle of the present invention.

Referring to FIG. 5, the inlet portion 120, which is generally cylindrical, has an axial extent L' and the conical portion 122 has a length C' which terminates at outlet 126. Length L' is preferably about 1 to 36 inches and length C' is preferably about 5 to 24 inches. In the embodiment of FIG. 5, another form of male securement of the nozzle to the body portion may be provided. The tube wall has a hollow collar 110 secured thereto. The collar 110 is dimensioned to be received within the flexible nozzle. An external clamp 124, which may be of any sort of adjustable mechanically locking clamps, such as a hose clamp, for example, may be employed. The overall length of the nozzles is about 6 to 60 inches.

Figures 4A, 6:
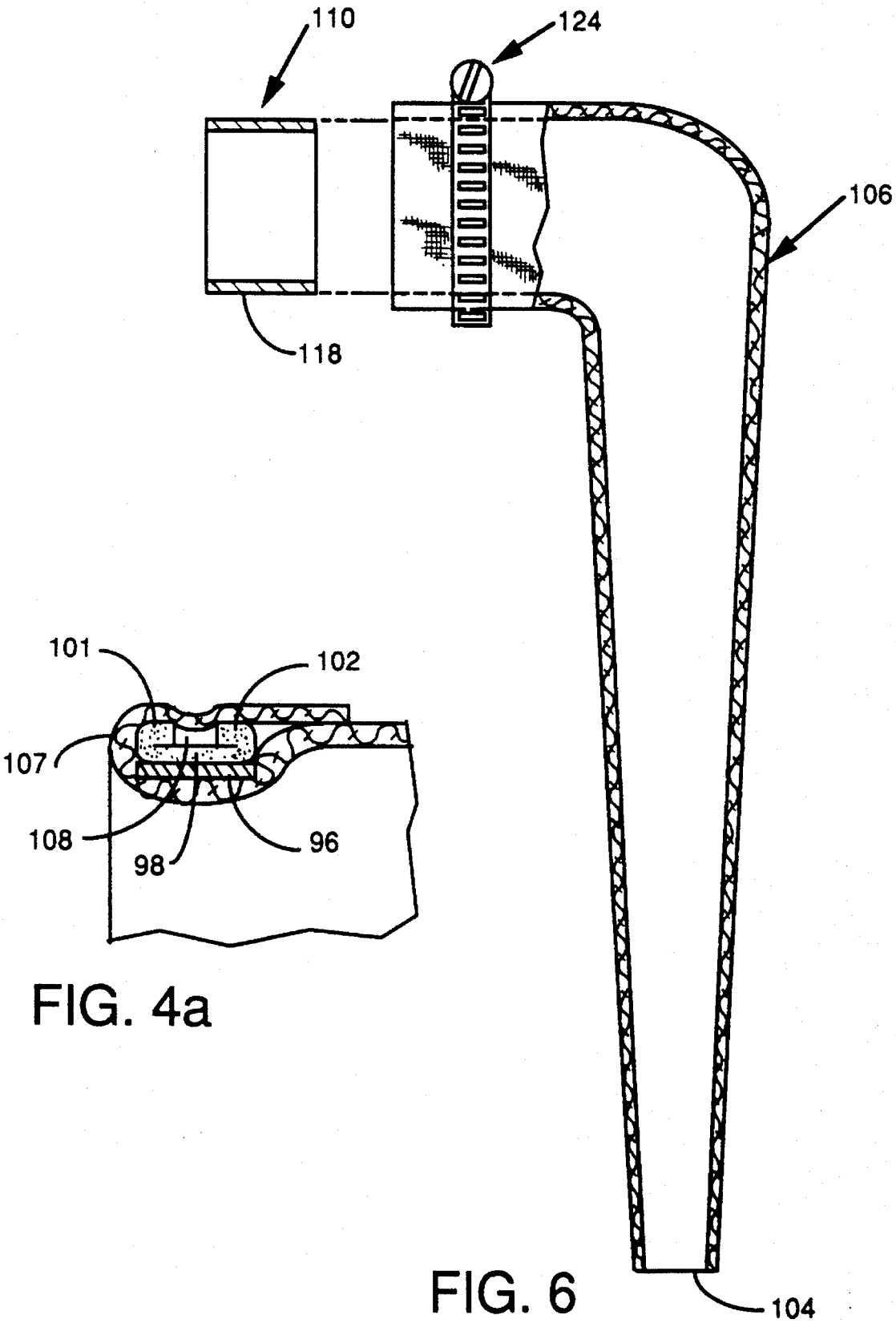
FIG. 4*a* is a detail of the portion of the nozzle of FIG. 4 which is attached to the tube wall.
FIG. 6 is a schematic view partially in cross-section of the nozzle of FIG. 4 shown in compressed state.

Referring to FIG. 6, there is shown the nozzle 106 of FIG. 4 when gas is not flowing therethrough. In this view, gas has not been flowing through the nozzle and, as a result, the normal horizontally projecting rigid nozzle, as shown in FIG. 4, has assumed a relaxed or collapsed position. In this manner, it will be appreciated that the distance between collar 110 and whatever workpiece is adjacent has been increased substantially, thereby minimizing the risk of inadvertent contact between a workpiece and the projecting nozzle, and also providing added space for visual inspection and physical entry into the region of the equipment.

Among the suitable materials for use in the collapsible nozzle application are a material selected from the group of woven cloths, spunbonded sheets or sheets consisting of plastics or composites (TEFLON, NOMEX, rip stop nylon, translucent or transparent plastic of the nature used for flat roll plastic tubing, TYVEK tear resistant spunbonded olefin (high density polyethylene), reinforced paper, and natural fibers. Imperviousness may be achieved by backing, such as bonded urethane and the like. High temperature applications may utilize graphitic materials, such as GRAFOIL or fiberglass. In addition, lightweight inflatable designs for high temperature applications may also use layered material with a dedicated cooling medium (air, water, water mist, refrigerant, etc.) flowing between layers. When the flexible nozzle must touch a surface which has a temperature greater than its thermal properties allow, lightweight insulating materials may be attached by various commercial means to thermally exposed areas. When the surrounding thermal or chemical conditions are beyond the resistance capability of the flexible material of construction and coatings are not appropriate, then a permeable material can be used which allows for transpiration cooling and purging of contaminants from the surface of the material. For less collapsible applications where some stiffness is desired, the material selected may be in the heavier weight forms of plastic sheet or needle punched felt into a scrim. The nozzle may be sewn from flat patterns or cast and vulcanized from flexible materials, such as neoprene rubber. In general, the fabric may be relatively thin walled on the order of about 0.001 inch to 0.125 inch and for thinner range about 0.001 to 0.008 inch depending on the material employed. Urethane backed rip stop nylon cloth of approximately 96×96 crossweave and approximately 0.004 inch thick exhibits highly desirable inflatability and flexibility characteristics for a flexible nozzle.

Figure 7:
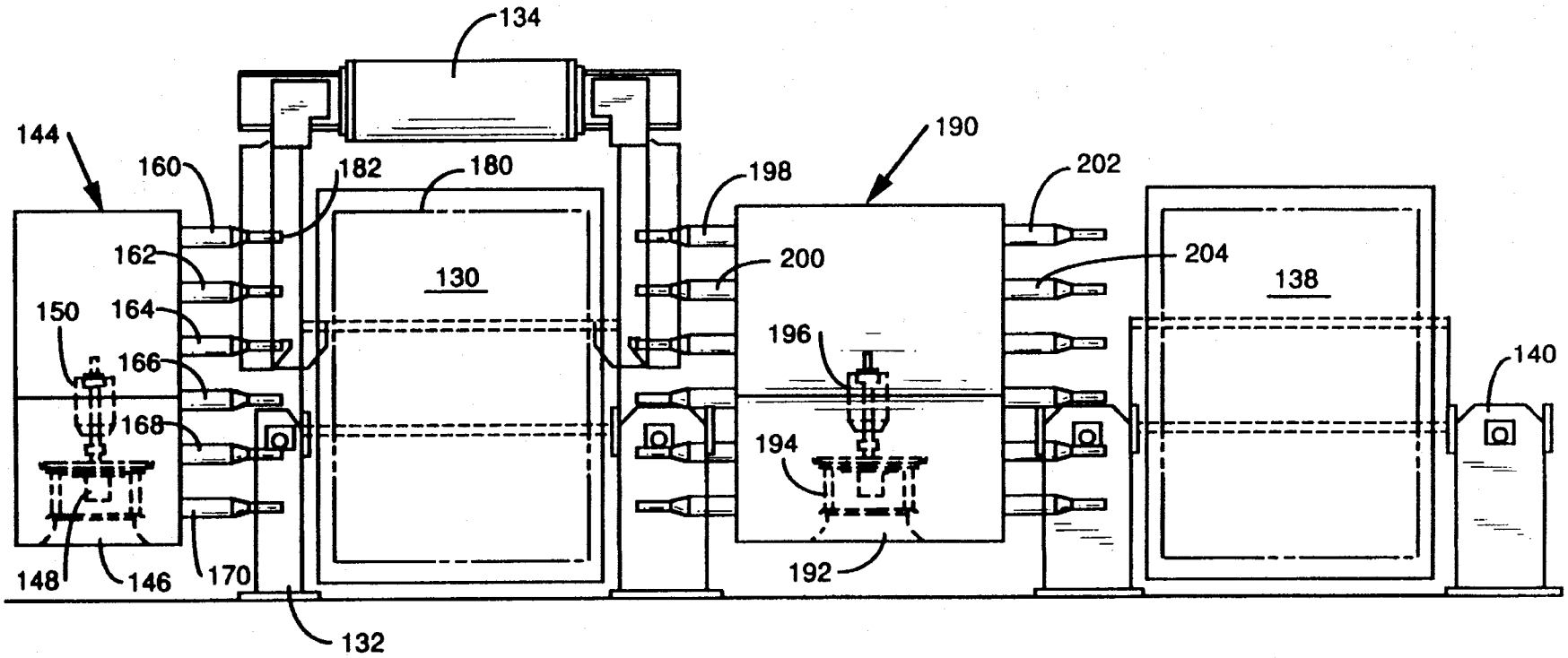
FIG. 7 is a schematic elevational view of a system for cooling two coils simultaneously.

Referring to FIG. 7, there is shown a system of the present invention employed in cooling metal coils. A first coil which, for example, may be aluminum or steel 130 is delivered to the location by an overhead crane 134 and is supported by a suitable coil rack 132. A second coil 138 is supported on a coil rack 140. A first unit of the present invention 144 has a gas intake 146, a fan impeller 148 rotatably driven directly by motor 150 and a plurality of nozzles which may be similar to the army shown in FIGS. 1 through 3, but which have been identified in this drawing as 160, 162, 164, 166, 168, 170. It will be appreciated that these nozzles 160–170 (even numbers only) are merely the end nozzles of the rows of nozzles such as those shown in FIG. 1 and that the apparatus may be of the same configuration as the apparatus shown in FIG. 1, except that it employs a bottom gas intake. As a majority of the heat escaping from a metal coil escapes from the edges, it is desired to effectively blanket the edges with cooling gas at a desired velocity and volume. The gas is preferably directed in the axial direction of said coil and generally uniformly covers substantially the entire edge of the coil. In a preferred embodiment, the distance between the edge of the coil 180 and the end of nozzle 182 will be about 6 and 16 inches with about 6 to 10 inches being preferred. If it were not for the flexible nozzles, the distances between the edge of coil 180 and the end of nozzle 182 would be about 30 inches to facilitate moving the coil, normal inspection operations and maintenance. It will be appreciated that the flexible nozzles of the present invention facilitate a reduction in this distance as the collapse of the nozzles during periods when the gas is not flowing increases the spacing between the equipment and the coil edge.

The apparatus 144 has nozzles projecting from only one side of the body portion. Also, direct air intake from the lower levels of the room where the colder air tends to be is contemplated, but, if desired, ducts could be employed to bring in special gas in terms of temperature, moisture content, or any other parameter desired. It will also be noted that the air intake in equipment 144 faces directly downwardly, whereas that of FIG. 1 faces angularly to each side.

Apparatus 190 similarly has an air intake 192 and fan impeller 194 powered directly by motor 196. It has nozzles such as nozzles 198, 200, for example, and 202, 204, for example, projecting in opposite directions. In this manner, gas treatment equipment 144 and 190 combine to cool coil 130 from both edges in a generally axial direction. Unit 190 also cools coil 138 simultaneously with the cooling air distributed to coil 130.

As shown in figures in the preferred embodiments, the nozzles will be cantilevered and require no external support at the free ends thereof. The nozzles preferably have (a) a supported inlet end and (b) a free end supported solely by other portions of the nozzle or in the case of the flexible nozzles supported in the projecting position by other portions of the nozzle and the gas flowing therethrough.

It will be appreciated to those skilled in the art that various combinations of cooling arrangements or gas treatment arrangements may be provided within the context of the present invention.

It will be appreciated that the nozzles of the present invention are such that due the fabric nature, if adjustment in length is desired or replacement thereof is desired, this may be accomplished rapidly and economically.

The method of the present invention involves providing gas handling means having the characteristics described and illustrated hereinbefore, initiating gas treatment by beginning flow out of the nozzles to cause the nozzles to assume an extended position under the influence of the gas and subsequently causing the nozzles to assume a non-extended position by terminating flow of gas therethrough.

While for simplicity of disclosure herein, reference has been made to coils made of metal, other types of coils, such as plastic coils or other types of workpieces may be treated.

While for purposes of convenience of disclosure herein, emphasis has been placed on the cooling of coils, it will be appreciated that the flexible nozzles of the present invention may have many uses in connection with gas handling involved with heating, cooling, wiping and drying. In addition, other uses will be apparent to those skilled in the art, such as directing fumes emerging from rolling mill lubricant vaporization in desired directions to enhance evacuation, as well as other environmentally desirable approaches. Reference herein to direction of gas stream to a "workpiece" shall be deemed to embrace such usages.

While for purposes of illustration herein, there has been shown nozzles so positioned as to have their longitudinal axis when in gas flow induced extended position is a generally horizontal orientation, it will be appreciated that the nozzle axis when inflated and functioning to deliver gas may be provided with any desired orientation. Also, while some embodiments have been shown with rigid nozzles, such as FIGS. 1–3 and 7 and, others with flexible nozzles, such as FIGS. 4–6, nozzles from one embodiment may be employed with another embodiment, if desired.

It will be appreciated, therefore, that the present invention has provided an efficient apparatus and associated method for supplying treatment gas for a variety of uses. In a preferred practice of the invention, the gas handling means has a body portion associated with a plurality of discharge nozzles which may be directed in one direction, two directions or in more than two directions merely by effecting communication between the gas intake means and nozzle positions in the desired locations with appropriate powered flow creating means such as fans to move the gas. The flexible nozzles not only resist undesired potentially damaging contact between the nozzles and workpieces, but also automatically assume a non-obstructing position when gas flow of the desired velocity and volume is not present.

The use of flexible nozzles further provides flexibility of modification. For example, the nozzle performance may be altered by adjusting the discharge diameter as by clamping, folding, or cutting the nozzle. Similarly, the nozzle length may be varied.

The flexible nozzle may be provided so as to totally collapse and retract when gas supply is withdrawn, such as is shown in FIG. 6, or to only partially collapse depending on the material out of which it is made and the geometry thereof to achieve desired stiffness. Also, nozzle flexibility can be employed to effect a curved flow path for the fluid where direct flow toward the intended target is obstructed.

While for convenience of disclosure herein, reference has been made to either the rigid nozzles or the flexible nozzles having a horizontal orientation, it will be appreciated that depending upon the use, they could have a vertical or other orientation.

Whereas particular embodiments of the invention have been disclosed and described herein for purposes of illustration, it will be evident to those skilled in the art that numerous variations of the details may be made without departing from the invention as set forth in the appended claims.

I claim:

1. Apparatus for supplying treatment gas comprising gas handling means having a body portion for receipt and discharge of said gas, said gas handling means having a plurality of elongated nozzles for discharging said gas from said gas handling means, said nozzles being flexible so as to assume a substantially rigid projecting position when gas is flowing through said nozzles and a collapsed or partially collapsed position when said gas is not flowing therethrough, said flexible nozzles having an inlet portion and an outlet portion, said inlet portion being of larger cross-sectional area than said outlet portion, said inlet portions being generally cylindrical, and said outlet portions being generally conical.

2. Apparatus for supplying treatment gas comprising gas handling means having a body portion for receipt and discharge of said gas, said gas handling means having a plurality of elongated nozzles for discharging said gas from said gas handling means, said nozzles being flexible so as to assume a substantially rigid projecting position when gas is flowing through said nozzles and a collapsed or partially collapsed position when said gas is not flowing therethrough, said flexible nozzles having an inlet portion and an outlet portion, said inlet portion being of larger cross-sectional area than said outlet portion, said nozzles being mounted so as to assume a generally horizontal position responsive to flow of said gas therein, said gas handling means having a first set of nozzles projecting in a first direction from said body portion, and said gas handling means having a second set of nozzles projecting in a second direction from said body portion.

3. The apparatus of claim 2 including said first and second directions having an angle between them of approximately 180 degrees.

4. A method of treating a workpiece with gas comprising providing gas handling means having a body portion for receipt and discharge of gas and a plurality of elongated cantilevered nozzles for discharging gas from said gas handling means, employing no external support at the free ends of said cantilevered nozzles, employing a first set of nozzles projecting in a first direction from the body portion of said air handling means and a second set of nozzles projecting in a second direction from said body portion of said gas handling means with said first and second directions having an angle between them of approximately 180 degrees, positioning said nozzles with their free ends about 6 to 16 inches from said workpiece, initiating gas treatment by beginning flow of gas out of said nozzles in a direction generally perpendicular to said workpiece, employing flexible nozzles as said nozzles, and employing said method to cool metal coils by cooling gas applied to the edges of said coil.

5. Apparatus for supplying treatment gas comprising gas handling means having a body portion for receipt and discharge of said gas, said gas handling means having a plurality of elongated nozzles for discharging said gas from said gas handling means, said nozzles being flexible so as to assume a substantially rigid projecting position when gas is flowing through said nozzles and a collapsed or partially collapsed position when said gas is not flowing therethrough, said flexible nozzles having an inlet portion and an outlet portion, said inlet portion being of larger cross-sectional area than said outlet portion, said nozzles being mounted so as to assume a generally horizontal position responsive to flow of said gas therein, said nozzles being arranged in a plurality of generally parallel generally horizontal rows, and the nozzles of one said row being offset with respect to the nozzles of an adjacent said row.

6. The apparatus of claim 5 including said nozzles being sufficiently flexible so as to substantially completely collapse responsive to reduction or termination in gas flow.

7. The apparatus of claim 5 including said gas handling means having gas supply means for supplying at least one of heating, cooling, wiping and drying gas to said gas handling means.

8. The apparatus of claim 5 including said nozzles having a length of about 6 to 60 inches.

9. The apparatus of claim 8 including said nozzles having an outlet diameter of about 1 to 6 inches.

10. A method of treating with gas comprising providing gas handling means having a body portion for receipt and discharge of gas and a plurality of flexible elongated nozzles for discharging gas from said gas handling means, initiating gas treatment by beginning flow of gas out of said nozzles to cause said nozzles to assume an extended position under the influence of said gas, subsequently causing said nozzles to assume a non-extended position by terminating said flow of gas, employing said flexible nozzles with an inlet portion of greater cross-sectional area than the outlet portion, and employing nozzles having an inlet portion which is generally cylindrical and an outlet portion which is generally conical.

11. A method of treating a workpiece with gas comprising providing gas handling means having a body portion for receipt and discharge of gas and a plurality of cantilevered flexible elongated nozzles for discharging gas from said gas handling means, initiating gas treatment by beginning flow of gas out of said nozzles to cause said nozzles to assume an extended position under the influence of said gas and direct said gas in a path toward and generally perpendicular to said workpiece, subsequently causing said nozzles to assume a non-extended position by terminating said flow of gas, and removably securing said nozzles to said body portion.

12. A method of treating with gas comprising providing gas handling means having a body portion for receipt and discharge of gas and a plurality of flexible elongated nozzles for discharging gas from said gas handling means, initiating gas treatment by beginning flow of gas out of said nozzles to cause said nozzles to assume an extended position under the influence of said gas, subsequently causing said nozzles to assume a non-extended position by terminating said flow of gas, and employing said treatment in cooling.

13. A method of treating with gas comprising providing gas handling means having a body portion for receipt and discharge of gas and a plurality of flexible elongated nozzles for discharging gas from said gas handling means, initiating gas treatment by beginning flow of gas out of said nozzles to cause said nozzles to assume an extended position under the influence of said gas, and subsequently causing said nozzles to assume a non-extended position by terminating said flow of gas, and employing a first set of nozzles projecting in a first direction from the body portion of said gas handling means and a second set of nozzles projecting in a second direction from said body portion of said gas handling means with said first and second directions having an angle between them of approximately 180 degrees.

14. Apparatus for supplying treatment gas comprising gas handling means having a body portion for receipt and discharge of said gas, said gas handling means having a plurality of elongated nozzles for discharging said gas from said gas handling means, said nozzles being flexible so as to assume a substantially rigid projecting position when gas is flowing through said nozzles and a collapsed or partially collapsed position when said gas is not flowing therethrough, said apparatus being coil cooling apparatus, and a first array of said nozzles having a plurality of rows of said nozzles for directing said gas generally in a first direction.

15. The apparatus of claim 14 including said rows of nozzles having nozzles of one row offset with respect to nozzles of an adjacent said row.

16. The apparatus of claim 15 including a second array of said nozzles for directing said gas in a generally second direction with the first and second directions having an angle between them of approximately 180 degrees.

17. The apparatus of claim 16 including said gas handling means having gas inlet means, and said gas handling means having flow creating means for transporting gas from said inlet means to said nozzle means.

18. The apparatus of claim 17 including said gas handling means having a first support wall to which said first array of nozzles is secured and a second support wall to which second array of nozzles is secured, and each said support wall having generally parallel upper and lower ends and sidewalls which converge generally upwardly.

19. The apparatus of claim 14 including at least one of said nozzle rows having a different number of nozzles than other said nozzle rows.

20. A method of treating with gas comprising providing gas handling means having a body portion for receipt and discharge of gas and a plurality of flexible elongated nozzles for discharging gas from said gas handling means, initiating gas treatment by beginning flow of gas out of said nozzles to cause said nozzles to assume an extended position under the influence of said gas, subsequently causing said nozzles to assume a non-extended position by terminating said flow of gas, employing said nozzles to cool metal coils, and positioning the discharge ends of said nozzles a predetermined distance from said coils.

21. The method of claim 20 including positioning said discharge ends of said nozzles so as to direct said gas toward the edge of said coil.

22. The method of claim 21 including directing said gas in a generally axial direction with respect to said coil.

23. The method of claim 22 including positioning said coils such that the free ends of said nozzles will be about 6 to 16 inches from the coil edge after gas flow has been initiated in said nozzles.

* * * * *